US007571904B2

(12) United States Patent
Bober

(10) Patent No.: US 7,571,904 B2
(45) Date of Patent: Aug. 11, 2009

(54) CONTROL SYSTEM FOR INDEXING COMPILER DRIVE SHAFT THAT SENSES DRIVE TORQUE TO INITIATE INDEXING

(75) Inventor: Henry T. Bober, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 449 days.

(21) Appl. No.: 11/635,152

(22) Filed: Dec. 7, 2006

(65) Prior Publication Data

US 2008/0136090 A1 Jun. 12, 2008

(51) Int. Cl.
*B65H 37/04* (2006.01)

(52) U.S. Cl. ..... 270/58.12; 270/58.07; 270/58.11; 270/58.17; 270/58.27

(58) Field of Classification Search ..... 370/58.07, 370/58.11, 58.12, 58.17, 58.27
See application file for complete search history.

(56) References Cited

U.S. PATENT DOCUMENTS 5,114,306 A * 5/1992 Sjogren et al. ..... 414/790.4
6,471,429 B1 * 10/2002 Isobe et al. ..... 400/582
6,702,279 B2 * 3/2004 Adachi et al. ..... 271/220

* cited by examiner

*Primary Examiner*—Gene Crawford
*Assistant Examiner*—Leslie A Nicholson, III
(74) *Attorney, Agent, or Firm*—James J. Ralabate

(57) ABSTRACT

A finishing-compiling station or structure is disclosed where marked copies of paper or other media are transported into a compiling tray for paper registration by paddle wheels or other such deflection loaded compiler drive elements. These sheets of paper after registration are then processed and finished as desired. The pressure applied by the paddle wheels is substantially constant where as prior art pressures varied depending upon the height of the paper stack. A sensor and appropriate software controller gauges the speed of the paddle wheel drive shaft and controls the height of the drive shaft from the stack and thereby equalizes the resulting pressure to a continuous fixed pressure throughout this stacking operation.

15 Claims, 10 Drawing Sheets

CONTROL SYSTEM FOR INDEXING COMPILER DRIVE SHAFT THAT SENSES DRIVE TORQUE TO INITIATE INDEXING

This invention relates to media or paper moving marking systems and apparatus and, more specifically, to a finishing compiling structure useful in said systems and apparatus.

BACKGROUND

Marking systems that transport paper or other media are well known in the art. These marking systems include electrostatic marking systems, non-electrostatic marking systems, printers or any other marking system where paper or other flexible media or receiving sheets are transported internally to a an output device such as a finisher and compiler. Many machines are used for collecting or gathering printed sheets so that they may be formed into books, pamphlets, forms, sales literature, instruction books and manuals and the like.

The finisher and compiler are located at a site in these marking systems after the receiving sheets (paper) have been marked. A finisher is generally defined as an output device that has various post printer functions or options such as hole punching, corner stapling, edge stapling, sheet and set stacking, letter or tri-folding, Z-Folding, Bi-folding, signature booklet making, set binding [including thermal, tape and perfect binding], trimming, post process sheet insertion, saddle stitching and others.

The compiler often employs a compiling wall or tray where frictional drive elements hereinafter elastomer paddle wheels or "paddle wheels" (PW) are used to drive sheets (paper) against the compiling wall for registration of the staple or bind edge of a set. If desirable, belts or scuffer wheels may be used, etc. instead of paddle wheels. The force of these frictional drive elements on the sheet is critical and, must be controlled within narrow limits. In the case of Deflection Loaded technologies such as Paddle Wheels, the compiler element drive force has been found to be dependent on the height of the drive element from the sheet In many such finisher compiling systems, the compiler drive element is periodically indexed or raised to attempt to compensate for stack build up. Sheet counting is frequently used as a criteria to index the Compiler Drive element shaft but it does not successfully comprehend curl build up or variations in media weight/thickness. Adding a Stack Height Sensor is also common but expensive.

The compiling capacity and bind edge sheet registration can be compromised with moderate to severe curl on the sheets. The curl can be concave up or concave down and curl build-up generally progressively increases as the paper stack height grows. Excessive curling can cause poor set registration and possibly paper jams or sheet damage.

As discussed above in [003] finisher compiling systems often employ frictional drive elements such as foam scuffer wheels or elastomeric paddle wheels to drive the individual sheets square (deskewed) and against the registration edge. With such compliant drive elements, the normal force on the paper and, thus, the drive force, will increase as the stack height builds up in the compiler tray. As the distance between the shaft and the top of the paper stack decreases, the compression of the foam roll or the deflection of the paddle blades increases and with it the normal and drive forces that are transmitted to the top sheet of the stack.

Over a short distance (change in stack height) this change in force will be minimal. However, with 50 to 100 and 100+ sheet stacks of curled paper of various media weights (gsm), sizes and conditions, the analytical simulation, testing and experience shows that the increase in drive force can become exponential as the stack to drive element shaft gap diminishes. Too little drive force and the sheets will not be properly registered or deskewed. Too much drive force and the top sheets will buckle causing poor set registration and possibly sheet damage or a jam or limiting set size (thickness) compiled.

Differences in media weight and curl will have significant, if not, dramatic effects on the actual stack height build-up, shaft to stack gap and, thus, the drive force. Sheet counting cannot predict or reasonably compensate for the stack height variations across the full range of media weights, sizes and output curl.

A rapid increase in on-demand service to provide large-volume small-scale printing of brochures etc. by use of color/black and white multifunction machines has been exhibited. Even ordinary offices are stepping up their efforts at in-house production of conference paper, simple booklets, manuals and other materials by establishing service departments for intensively processing prints in large quantities. Such customers require post-processing functions such as high-speed/high-precision punching, stapling and paper folding work with simultaneous print output and realization of high-speed/high-quality print output with a high degree of reliability.

"Drive elements or frictional drive elements" as used in this disclosure and claims include any suitable drive element. Also, any number of paddle wheels usually elastomer and any suitable number of paddle wheel blades may be used. The size, type and number of paddle wheels and blades depend upon many variations in the paper used such as size of paper, weight of paper, coated or non-coated paper, paper for color prints, paper for monochrome prints, etc and the specific compiler tray geometry. Also, curl suppressors can be desirably used together with the paddle wheels to improve paper registration. The desired or ideal drive force of the paddle wheels will, of course, vary as the conditions, paper and paper size and other variables change or exist; this ideal drive force can be easily established through simple tests.

SUMMARY

As above noted, finisher compiling systems often employ frictional drive elements like elastomer paddle wheels to drive sheets against a compiling wall for registration. The force of these drive elements on the sheet is critical and dependent on the height of the drive element from the sheet. An embodiment of this invention provides control of the drive element height by monitoring the drive element load through the speed of its drive shaft. As the stack height increases and the shaft to stack gap gets smaller through stack build-up, the drive element is compressed more, increasing the drive force and torque on the shaft. The speed of a typical DC drive motor is proportional to the Driven Torque. A new aspect of this invention is indexing the drive shaft element upward based on drive shaft speed. A paddle blade home position sensor is mounted on the drive shaft and can be used to capture the time it takes for each shaft revolution for an average shaft speed calculation. An advantage of this embodiment is closed loop control on a parameter directly related to the sheet drive force critical parameter with only software changes. Controlling drive element height off of the media stack based on drive torque is a key to the present embodiments. The present invention provides sensing shaft rotation speed (which maps to torque) because a shaft home position sensor is already available but a motor current sensor (which also maps to torque) could also be used.

Another method or system often used involves sensing the stack height (at some point in the compiler tray) and to initiate the shaft indexing and raise the compiler drive element at some predetermined distance when the stack builds up to a predetermined height. This approach depends on how close the sensor can be positioned in the drive element to stack contact point. However, it may require an extra sensor, a driver and harnessing. The sensors might be optical or proximity type.

The present invention and this control scheme offers increased latitude and a more robust solution to compensating for unknown variables in the operation of the compiler drive element indexing system.

As earlier noted, any suitable number, type or size of blades or paddles may be used in the present invention. Depending upon the paper or media sizes, finisher speed and other conditions, the appropriate blades and paddles can be selected. Any type or size or number of blades can be used on a paddle, again depending upon the existing conditions of use.

At least one sensor is used to sense the average speed of the shaft, in this case the average time per revolution. This sensed information is then conveyed into a controller and software. When the Shaft Speed drops below the previously determined control limit, the software commands the Compiler Drive Element Shaft Indexing Mechanism to elevate or index a predetermined distance. This maintains a consistent drive element (paddle wheel) frictional drive force on the paper stack. The controller knows the normal shaft rotational speed (and therefore the sheet drive force of the drive elements to be maintained) and thereby continuously adjusts the shaft height off of the stack to maintain this normal shaft speed and thus the critical sheet drive force. This is maintained irrespective of the thickness of the paper or the curl build up of the stack. The speed of the drive motor (that is connected to the shaft) is of the torque of the paddle wheels which is related to the sheet drive force as one monitors the shaft speed to control the height of the PW off of the stack to control the PW torque and thus the sheet drive force. Controlled shaft speed is an outcome as the stack height builds up under Paddle Wheel or other deflection loaded compiler drive element:

The sheet drive force increases exponentially

The sheet contact radius of the blade decreases linearly

PW shaft torque is the product of sheet drive force & contact radius

One might suspect that they tend to offset each other; however, the force increases more rapidly than the radius decreases. Thus, the net result is that the torque still increases with increasing stack height and thus the paddle wheel shaft and motor speed slows.

DETAILED DISCUSSION OF DRAWINGS AND PREFERRED EMBODIMENTS

Figure 1:
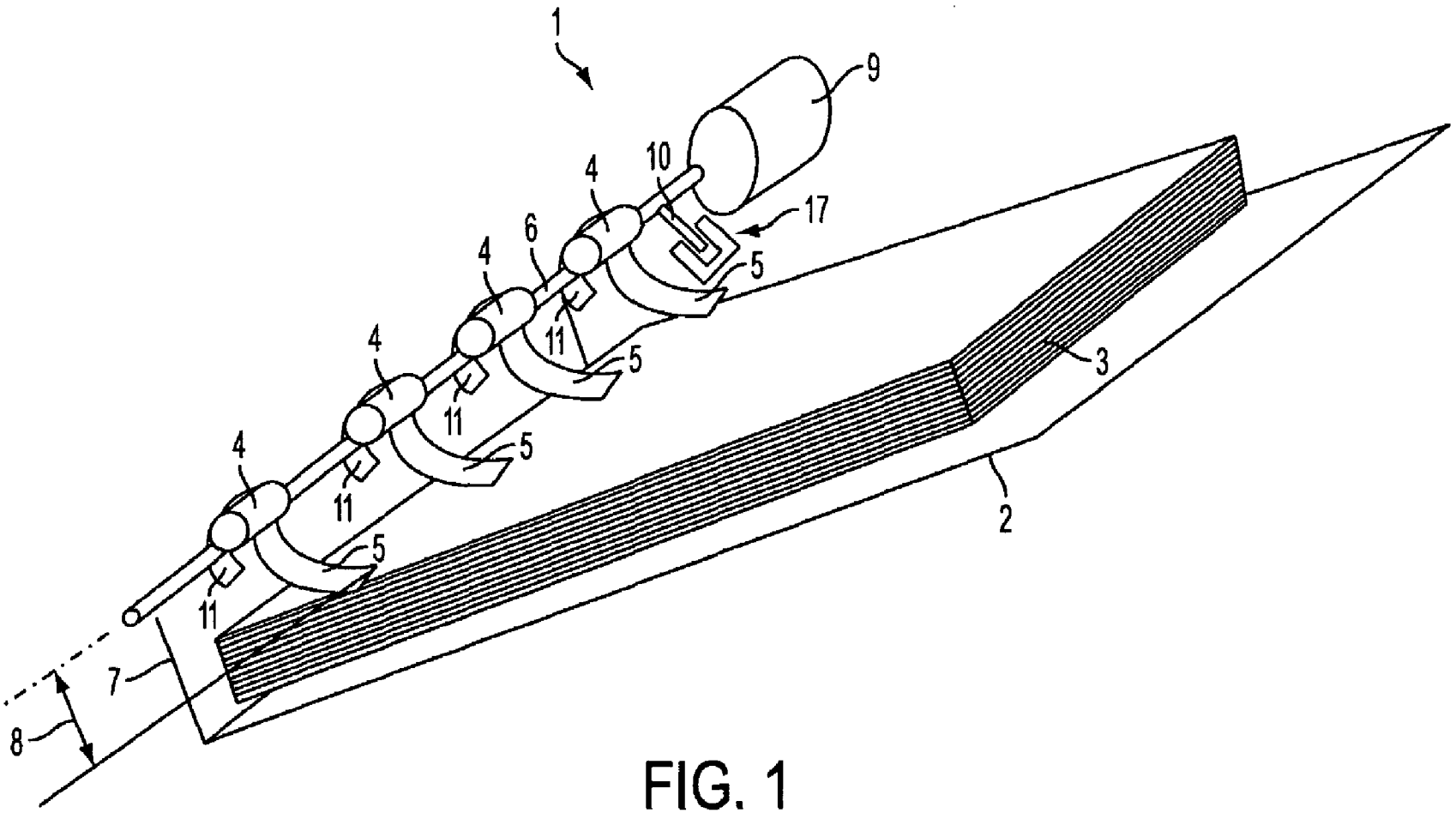
FIG. 1 illustrates an embodiment of a finisher-compiling station of this invention with an increased paper stack for registration.
Figure 2:
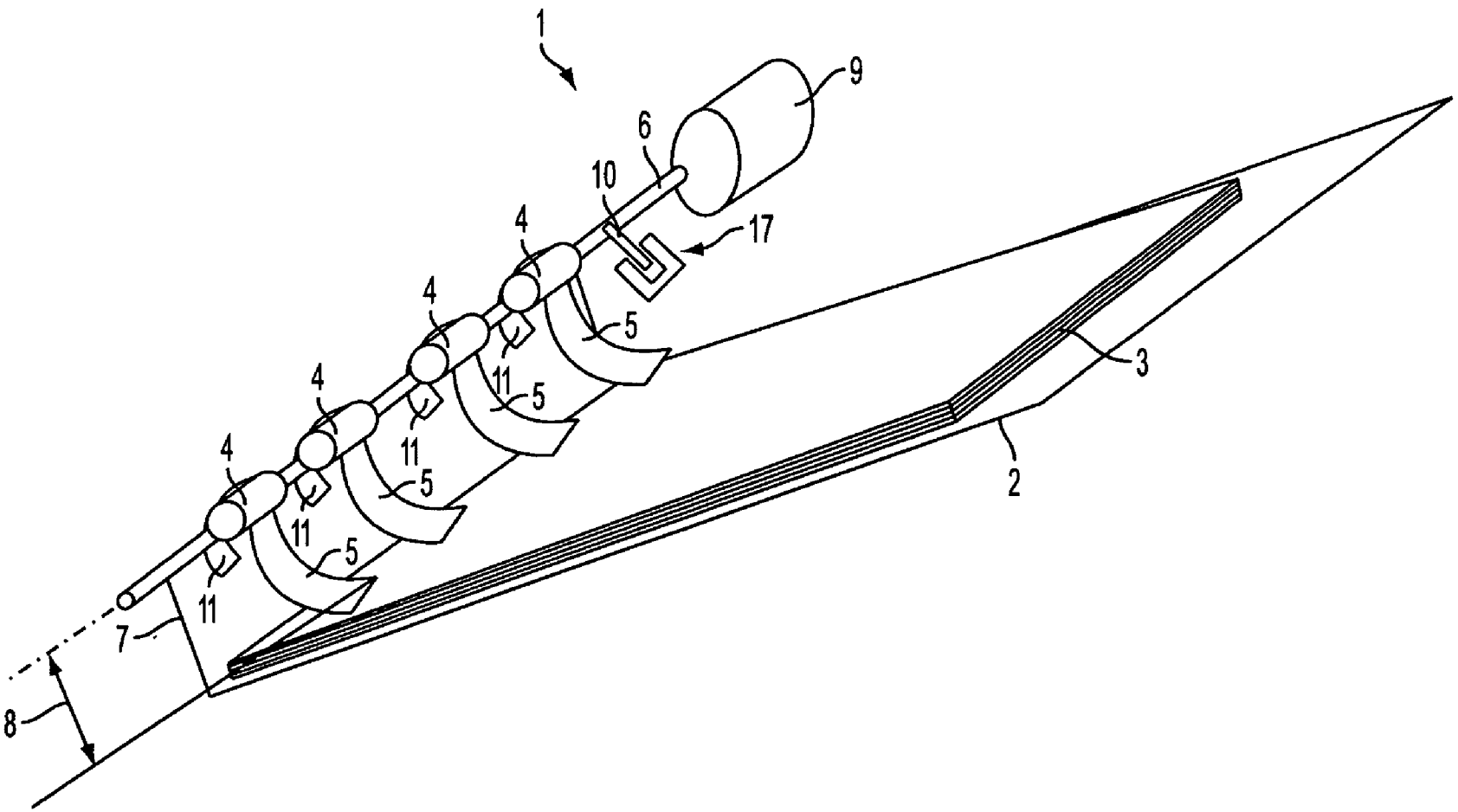
FIG. 2 illustrates an embodiment of a finisher-compiling station of this invention with a decreased paper stack for registration.

In FIGS. 1 and 2, a typical finisher-compiling station 1 is illustrated having a compiling tray 2 used to house and register paper stack 3 against the registration Guide or compiling wall 7

Above the paper stack 3 are paddle wheels or frictional drive elements 4 with paddle blades 5. The paddle wheels 4 are rotably mounted on drive shaft 6. The frictional drive paddle wheels drive sheets 3 against a compiling wall 7 for registration. The force of these drive elements 4 on the sheet or sheets 3 is critical and dependent on the height of the drive element 4 from the sheets 3. The present invention provides control of the height 8 of the compiler drive elements 4 above the paper stack 3 by monitoring the drive element load through the speed of drive shaft 6. As the height 8 gets smaller through stack build-up [whether due to paper thickness or curl, etc], the drive element 4 is compressed more increasing the drive force and torque on the shaft 6. The speed of the drive motor 9 is a function of the torque load on the shaft 6. The drive motor 9 is in operational contact with at least one shaft position sensor 17 and appropriate software. An aspect of this invention is indexing the compiler drive element 4 based on drive shaft 6 speed. A paddle wheel blade home position flag 10 is mounted on the drive shaft 6. A sensor 17 is mounted to the frame and is actuated by the passage of home position flag 10 once each shaft revolution. The flag 10 and sensor 17 are used to capture the time it takes to complete any given shaft revolution for the shaft speed calculation. Controlling compiler drive element height 8 based on compiler drive element torque is a key to the present embodiments. This invention provides sensing shaft rotation speed (which maps to drive element torque) since a shaft home position sensor 17 is already available in some present apparatus. A motor current sensor could also be used if suitable. Paddle wheels 4 have in an embodiment two sets of blades, $1^{st}$ blades 11 and $2^{nd}$ blades 5. However, as earlier mentioned, any suitable number of blades and wheels 4 may be used.

FIG. 2 shows a reduced number of sheets 3 thereby an increased distance 8, the space between the shaft 6 and the paper stack 3. Here the pressure exerted by the blades 5 upon the stack 3 is less than the pressure exerted on the higher stack 3 of FIG. 1. It is important to maintain a controlled pressure on the stack 3 because, if the pressure on the paper stack is too great, the top sheet is overdriven and will slide up the back guide (up curl) or buckle severely and wedge itself between the stack and the back guide (down curl) or the sheets are overdriven, will buckle up and obstruct the compiler throat (down curl) causing the next sheet to jam. All contribute to a distorted stack and poor registration. If the pressure on the stack is too small, the top sheet is not pulled back against the back guide properly producing a poorly registered set. Optimization is best accomplished by well-structured parameter testing.

In FIGS. 1 and 2 the distance 8 (height of stack 3 from shaft 6) varies thereby resulting in an undesirable variation of the pressure of blades 5 on the stack 3. Embodiments of the present invention involve providing tray 2 and/or shaft 6 with vertical movement so that space 8 can remain consistent and this pressure thereby will be controlled within acceptable performance limits. Any suitable means may be used to move tray 2 up or down, and/or shaft 6 up or down so that a substantially constant blade pressure can be maintained against the compiled sheets. A sensor(s) and controller (with suitable software) can determine when tray 2 and/or shaft 6 need to be moved. The controller 9 software is enabled to signal a suitable indexing system to move the shaft 6 up and/or tray 2 down. Shaft speed is an outcome or response to indexing the paddle wheel shaft 6. In this manner, distance 8 can be adjusted to remain substantially constant as the compiler tray stack height increases so that the drive pressure of paddle wheels 4 remain fixed within the predetermined pressure limits. In another embodiment, control of the drive element or paddles 4 height is monitored through the speed of its drive shaft 6. An aspect of this embodiment is indexing the drive element 4 up based on drive shaft 6 speed. Controlling drive element 4 height 8 above the top of the paper stack 3 based on drive torque is a key to the present embodiment. This invention provides sensing shaft rotation speed (which maps to torque) because a shaft position sensor is already available on some machines. Also, a current sensor to monitor the motor current, which also maps to torque for certain DC motors, can be used to initiate the shaft 6 indexing and maintain a substantially constant compiler drive element pressure on the top sheet of the paper stack.

Figure 3:
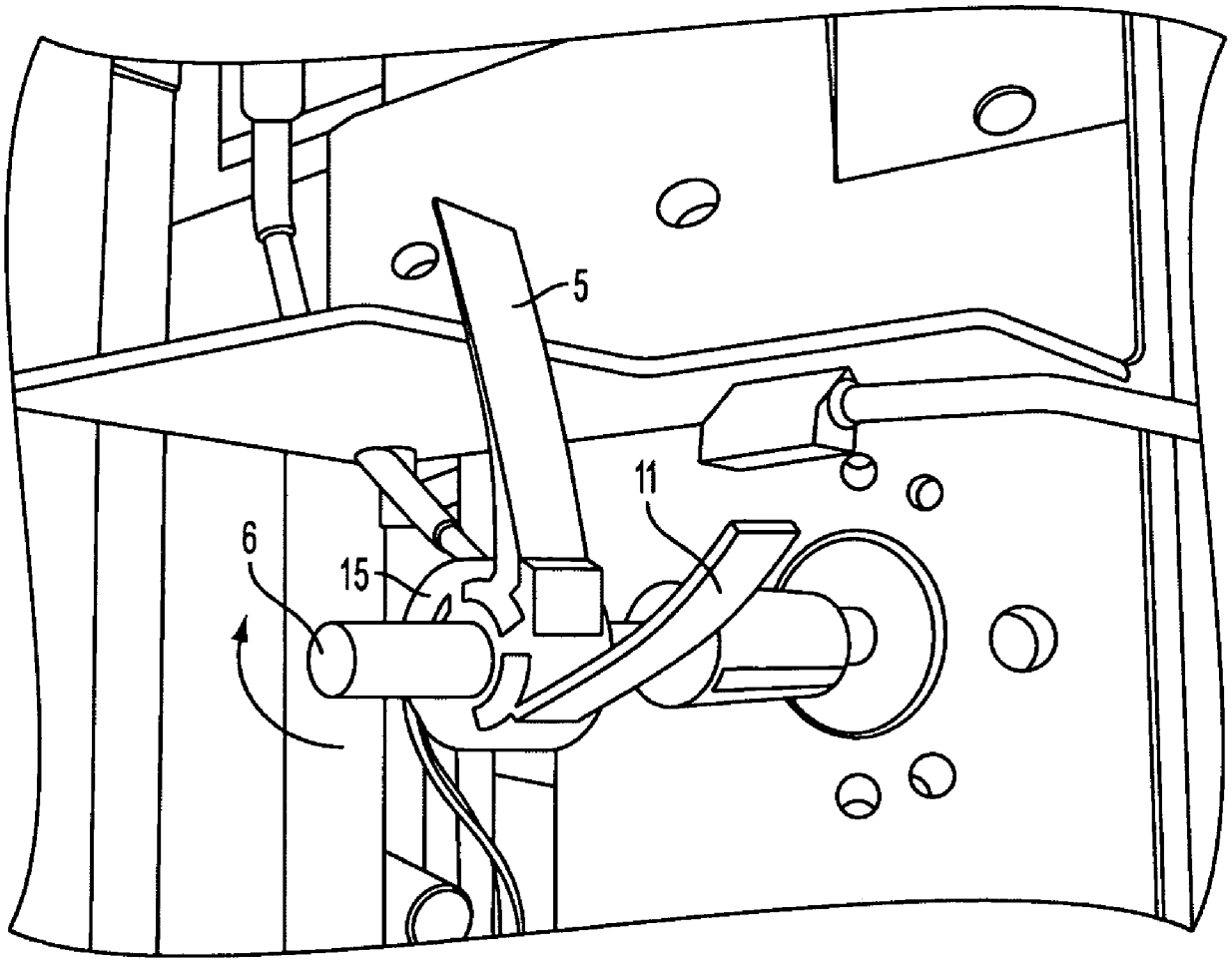
FIG. 3 is a configuration of a typical paddle wheel shaft and hub useful in the present invention.

FIG. 3 shows a typical paddle wheel 4, shaft 6 and hub 15 useful in the present invention. In this particular embodiment, the hub 15 is connected to a longer blade 5 and a shorter blade 11. The shaft 6 rotates thereby rotating blades 11 and 5 to contact and register paper 3 against a compiling wall 7.

Figure 4:
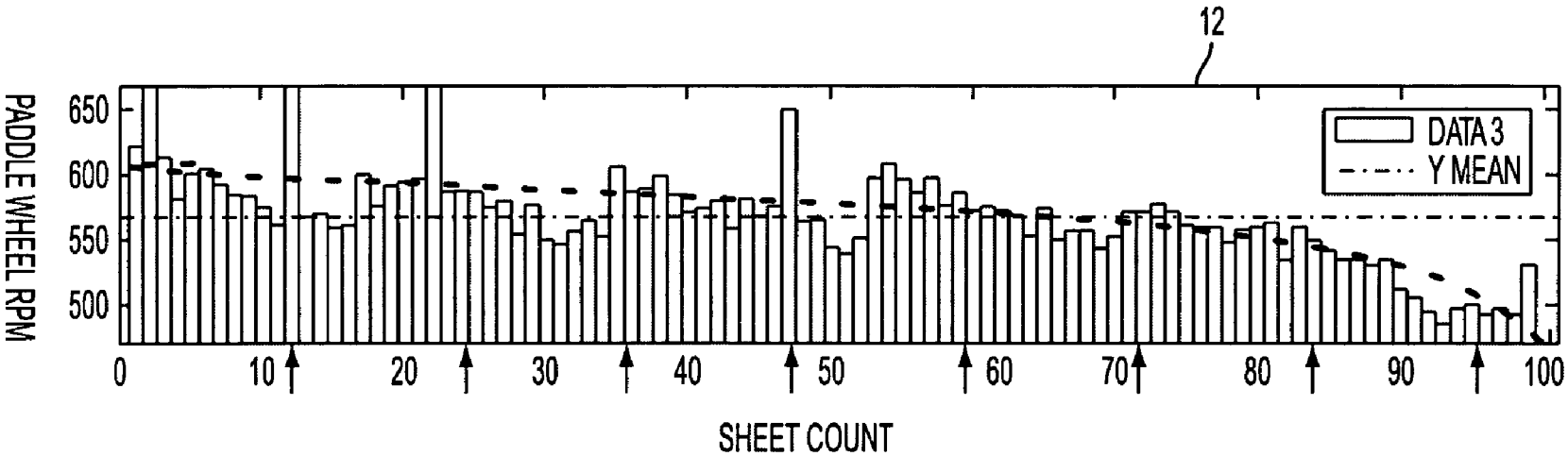
FIG. 4 is a graph that illustrates paddle wheel RPM as a function of paper stack build-up.

In FIG. 4, a bar graph 12 shows a paddle wheel 4 and paddle wheel shaft 6 rpm charted against sheet count. Paddle wheel RPM data is calculated from the actual paddle wheel shaft home position sensor 17 signal interval during a single shaft 6 revolution for a specific, typical finishing compiler system. In this particular example, the paddle wheel 4 is indexed every $12^{th}$ sheet and its speed still decayed/slowed down from 600 rpm to 500 rpm over a 100 sheet stack. As the stack builds up, the compiler element loads (normal and drive) on the top sheet 3 increase. The torque required to drive the compiler drive element also increases. And, with the type of DC motors that are very often used in this application, (i.e., a constant voltage, no speed control loop application), the compiler element drive shaft will slow down with the increased torque. While this invention refers generally to non speed controlled DC motors that are speed sensitive to torque, it could similarly be applied to any motor that has a torque/current sensitivity by monitoring the current draw of the motor 9. The paddle wheel type of compiler element is very often equipped with a home position sensor. This establishes its stop position and facilitates the synchronization of the paddle wheel operation with the arrival of the next sheet. Paddle wheels typically make multiple swipes for each sheet. The signal from this sensor can be utilized to determine shaft rpm based on the time between successive paddle wheel shaft rotations. No additional sensors, harnesses or drivers are required, only a few lines of software code to process available signals. Once the shaft speed has slowed to some predetermined rpm, a signal is sent to the paddle wheel shaft indexing mechanism. The shaft is indexed/raised by a predetermined amount. The shaft to stack gap 8 is increased (maintained) and the loads and torque are held within the desired ranges and critical compiling parameters are maintained within their required ranges for optimum registration performance.

Figure 5:
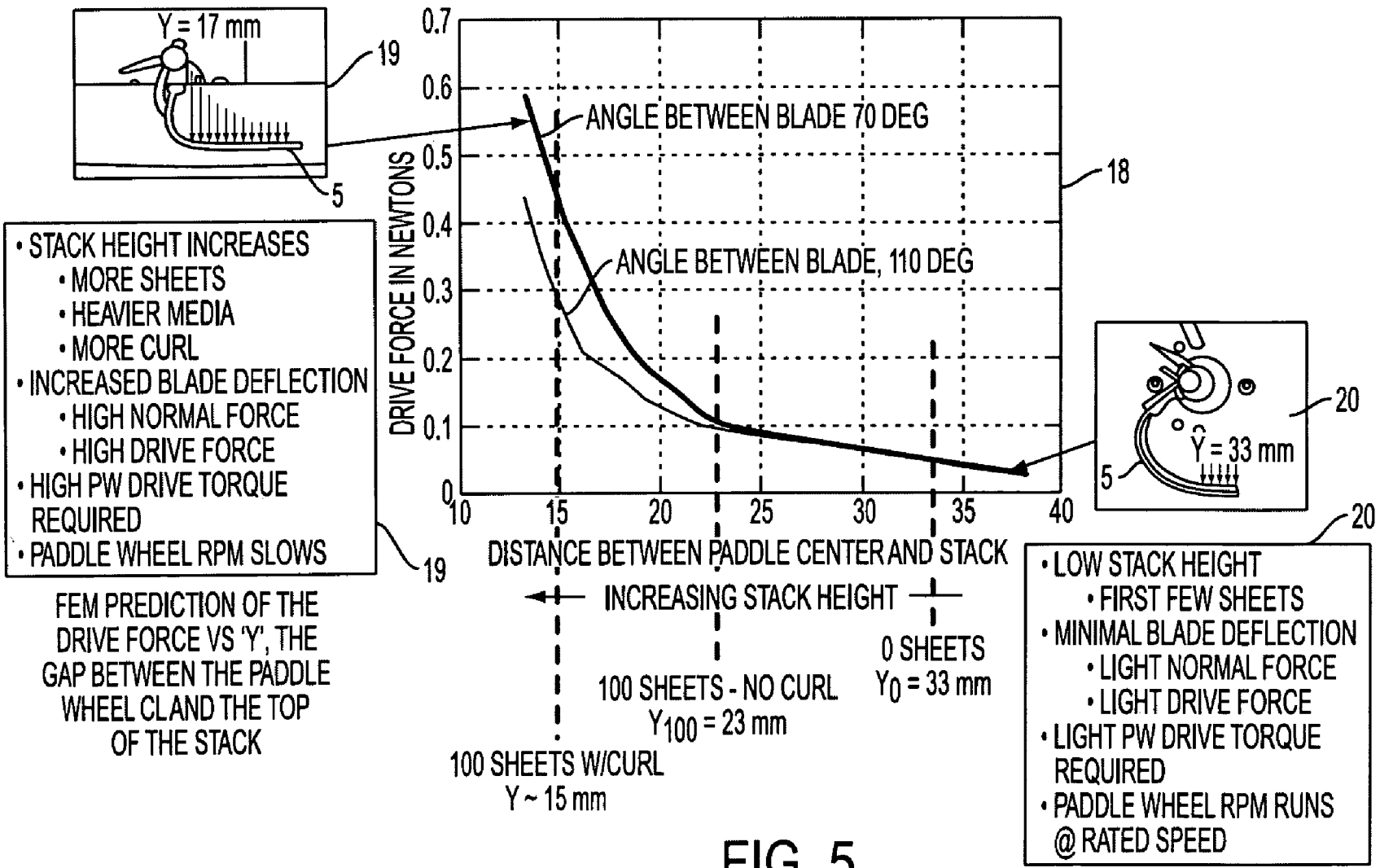
FIG. 5 illustrates the relationship of the distance between paddle wheel shaft and paper stack Vs, drive force in GMS.

FIG. 5 illustrates the graph 18 of a Finite Element Model [FEM] force/deflection analysis of a typical paddle blade 5. It plots the sheet drive force [along the ordinate or y axis] in grams vs the paddle shaft centerline to paper stack gap 8 for a particular, typical paddle wheel compiling mechanism. The initial sheets stacking into the compiler tray are depicted at the right extreme of the x axis where the gap 8 is a larger value. As more sheets are compiled and the stack 3 height increases and the gap 8 diminishes. This is depicted at the left end of the x axis where the gap 8 values are smaller. FIG. 5 very graphically displays the exponential nature of the increase in sheet drive force as the stack 3 builds up and the gap 8 decreases. It is this rapid increase in sheet drive force that limits the performance of paddle wheel compiler systems and other such deflection based frictional paper compiling systems. Controlling the sheet drive force within acceptable limits is critical to robust compiler performance and an insensitivity to curl levels and different media thicknesses. This invention addresses this issue by using motor speed to monitor increases in sheet drive force and to initiate the indexing of the paddle wheel shaft to increase gap 8 and to maintain the sheet drive forces within acceptable limits.

Inset 19 shows what occurs at the start of the compiling cycle, and inset 20 shows what occurs as stack height increases as the compiler tray is filled by subsequent incoming sheets:

| Inset 19: |
|---|
| Low Stack Height; first few sheets<br>Minimal blade deflection: light normal force; light drive force<br>Light PW drive torque required<br>Paddle wheel RPM runs at rated speed |

| Inset 20: |
|---|
| Stack Height increases; more sheets, heavier media, more curl<br>Increased blade deflection: high normal force; high drive force<br>High PW drive torque required<br>Paddle wheel RPM slows |

Figure 6:
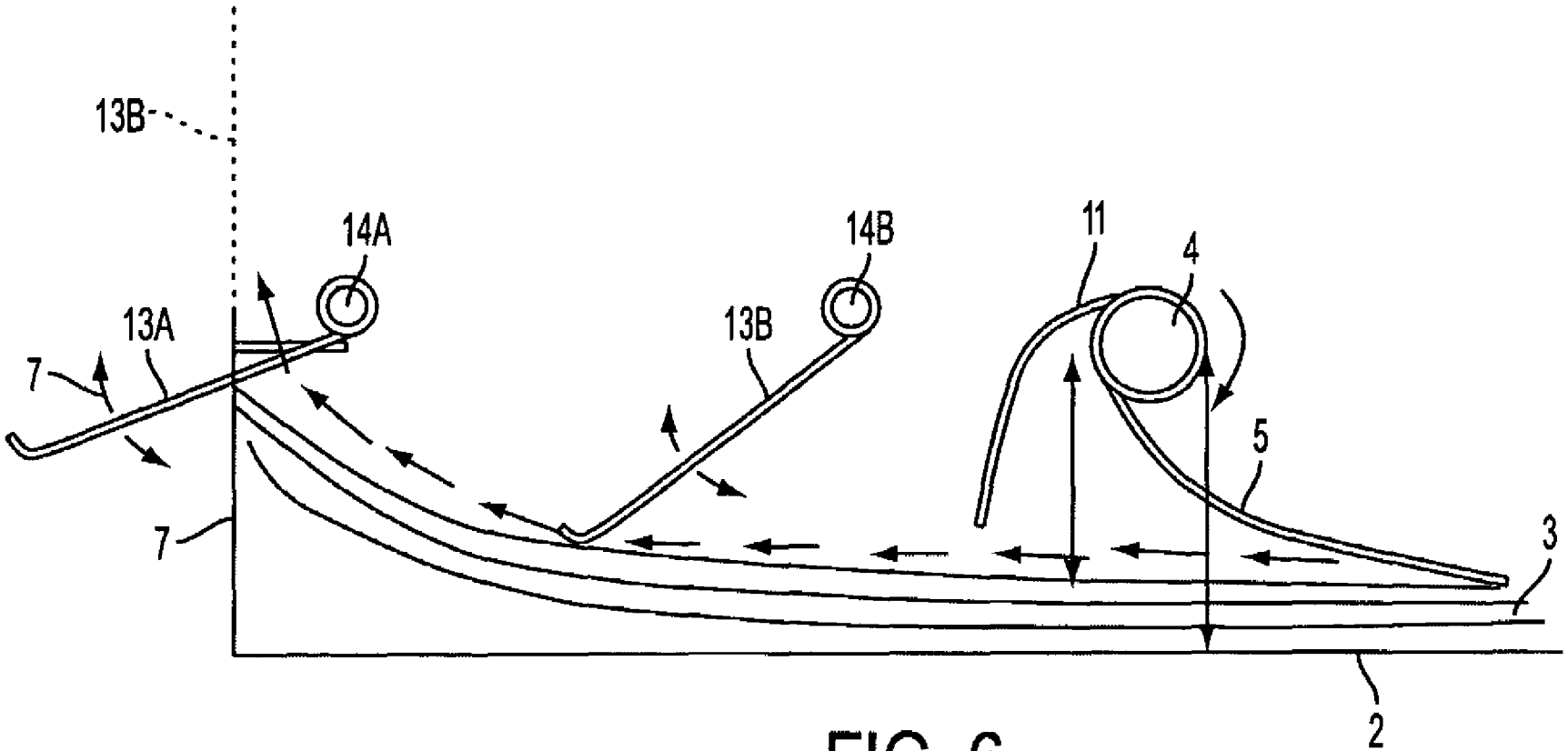
FIG. 6 is a side view of an embodiment of a finisher-compiling station illustrating the use of curl suppressors together with paddle wheel and compiler tray.

FIG. 6 is a side view of a finisher-compiler station 1 illustrating the use of curl suppressors 13*a* & 13*b* together with paddle wheel(s) 4 and compiler tray 2 wall 7. The curl suppressors 13*a* & 13*b* reduce the tendency of paper 3 to curl and degrade compiling registration accuracy or cause a paper jam or damage to the station 1. Paddle wheel 4 and blades 5 push paper 3 into the tray 2 and against wall 7 for registration. Curl suppressors 13*a* & 13*b* are lightly loaded against the stack 3 and rotate on suppressor pivots 14*a* & 14*b*.

Figure 7:
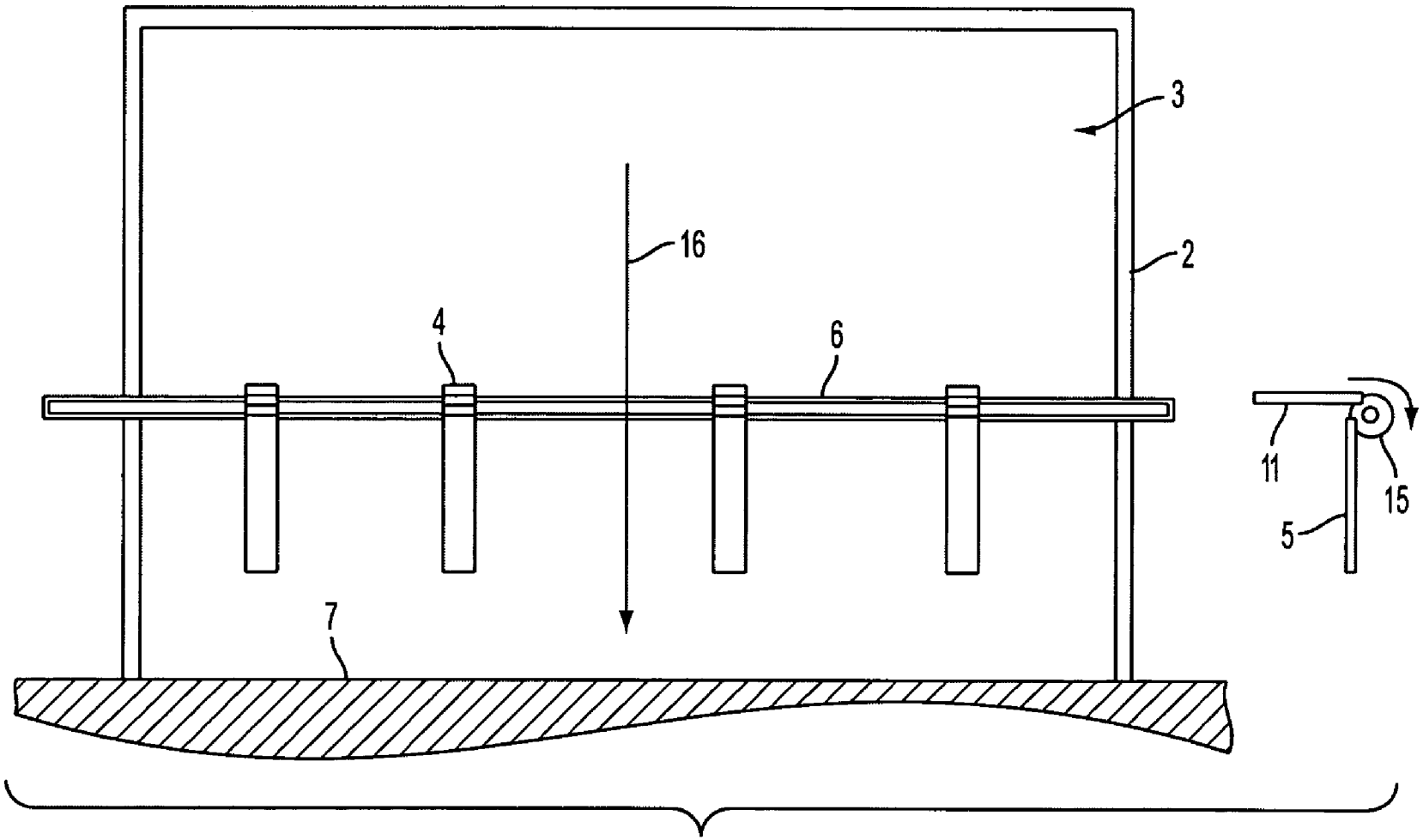
FIG. 7 is an embodiment using four paddle wheels with two blades on each wheel.

FIGS. 7-10 illustrate various embodiments of the present invention. In FIG. 7, a top view of a finishing-compiling station 1 is shown having a drive shaft or paddle wheel shaft 6 having rotably mounted thereon four paddle wheels 4 with hub 15. In this embodiment each paddle wheel 4 has two blades, a $1^{st}$ Blade 11 & a $2^{nd}$ Blade 5. The purpose of two blades 5 and 11 is to increase the peak sheet drive force [occurs when BOTH blades contact the sheet] and to extend the dwell time that the blade(s) are acting on the top sheet.

These parameters are controlled by the number of blades per paddle wheel, the length of the individual blades and the angular position of the Blades, one from the other. The compiling tray 2 has a compiling wall 7 against which the paper 3 is pushed for registration.

Figure 8:
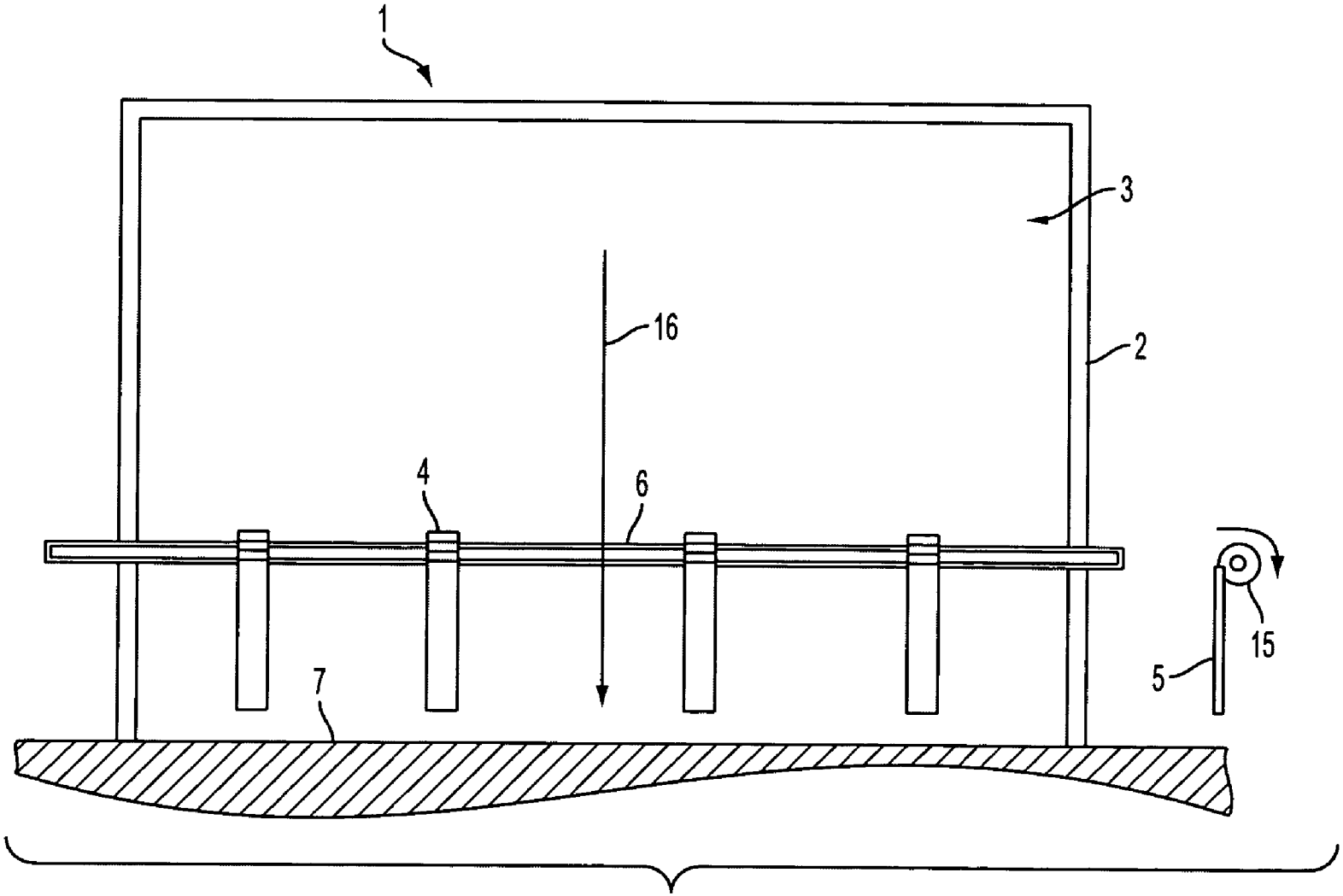
FIG. 8 is an embodiment using four paddle wheels with one blade on each wheel.

FIG. 8 shows four paddle wheels 4 with one blade 5 on each wheel 4. A registration edge or compiling wall 7 is used to align the papers in paper stack 3 after they are transported into compiling tray 2. The arrow 16 indicates the direction of the paper flow.

Figure 9:
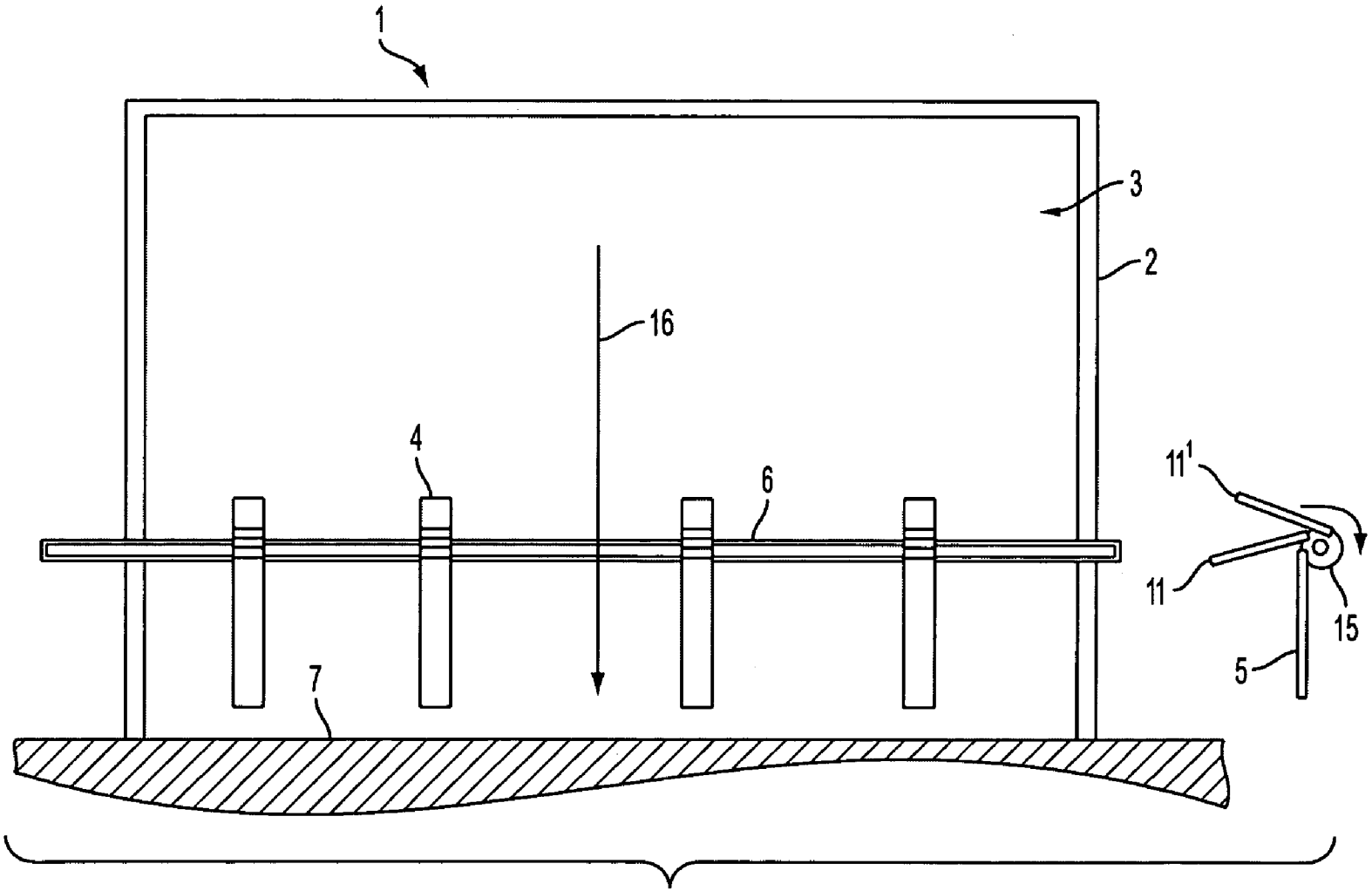
FIG. 9 is an embodiment using four paddle wheels with three blades on each wheel.

In FIG. 9, the same finishing station 1 is shown as in FIGS. 7 and 8 except each paddle wheel 4 has three blades 5, 11 and 11[1].

Figure 10:
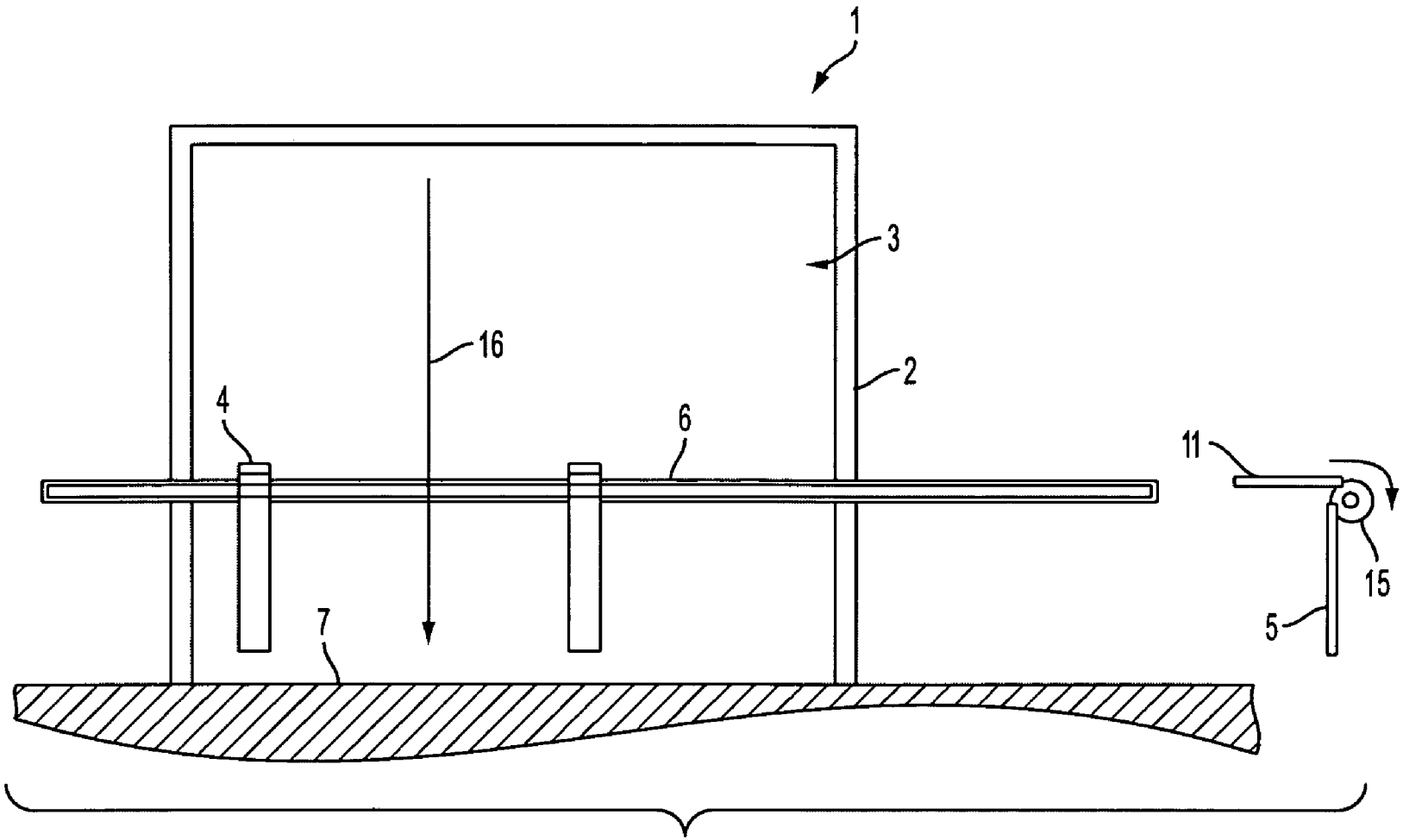
FIG. 10 is an embodiment using two paddle wheels with two blades on each wheel.

In FIG. 10, the same finishing station 1 is shown as in FIGS. 7, 8 and 9 except that two paddles 4 are used with two blades 5 and 11 on each wheel 4. Arrow 16 shows the direction of paper flow into tray 2.

To summarize specifics of embodiments of the present invention, a finisher-compiling structure is provided which is useful in a marking system which comprises in an operative arrangement at least one DC motor drive shaft, at least one deflection loaded frictional drive element rotably mounted on the drive shaft at a distance above the receiving sheets in a compiler tray. The compiler tray is adapted to house a stack of receiving sheets. The structure comprises also at least one drive shaft home position flag and sensor. The finisher is located in the marking system and positioned after a printer has marked the receiving sheet(s). The pressure or force on the deflection loaded drive element is dependent on at least one of (a) drive element material of (b) the drive element geometry and of (c) the distance from the drive element to the top of the stack of sheets. The control system software and sensor(s) will measure the shaft speed and will control distance from the drive element shaft to the stack of sheets.

At least one sensor and a home position flag is located in proximity to the shaft and the compiler tray. The sensor is enabled to sense shaft rotation speed and thereby enable the controller to maintain a substantially constant predetermined drive force of the drive elements on the receiving sheet(s). Appropriate software may be used with the controller or in the finisher structure. The receiving sheet(s) may be any receiving media such as paper, plastic and other suitable receiving media.

In the present embodiment, a pressure by the drive element upon the stack of receiving sheet remains substantially constant within acceptable force limits rather than having it increase upon a decrease of the distance between the receiving sheet and the compiler drive element shaft. Compliant elastomeric paddle wheels may be used in an embodiment using a finisher-compiling structure useful in a marking system for post marking finishing operations or steps. This structure comprises in an operative arrangement a compiler tray, at least a sensor, a drive shaft positioned above the tray, a source of power for the shaft, at least two deflection loaded drive elements fixed to the drive shaft. The deflection loaded drive elements are enabled to drive individual sheets of paper into a stack in the compiler tray and against a registration-compiling wall of the tray. The shaft and compliant wheels are adapted to maintain a substantially constant drive force. The tray and compliant wheels are adapted to maintain a substantially constant distance between the stack and the wheels. The sensor is in communication with the shaft and wheels height indexing mechanism to result in a substantially constant and fixed drive pressure to the stack.

The finisher in one embodiment also includes curl suppressors lightly loaded against the stack and rotably mounted on pivots mounted to the finisher-compiler apparatus structure. The speed of the compiler drive element shaft is measured by the home position flag and home position sensor. The shaft is enabled to be moved up or down to modify a distance of it from the top of the paper stack, and/or the tray is enabled to be moved up or down to modify its distance from the shaft.

The paddle wheels in an embodiment comprise elastomeric blades enabled to drive individual sheets square against the registration-compiler wall of the tray.

The shaft in one embodiment comprises rotably mounted thereon at least two paddle wheels. The curl suppressors have their own, dedicated pivots, mounted to the compiler system frame.

In a further embodiment, a finisher-compiling structure useful in a marking system for post marking finishing operations or steps is used. This structure comprises in an operative arrangement a compiler tray, at least a shaft rotary position sensor, a drive shaft positioned above the complier tray, a source of power for the shaft and at least two drive elements or paddle wheels rotably mounted on the drive shaft. Each of the paddle wheels has at least one blade. The paddle wheels are enabled to drive individual sheets of paper into a stack in the tray and against a registration-compiling wall of the tray. The shaft and wheels are adapted to maintain a substantially constant drive force. The tray and wheels are adapted to maintain a substantially constant distance between the stack and the wheels. The sensor has communication with the shaft and the paddle wheels to thereby provide information to the compiler element drive shaft height indexing system to result in a substantially constant and fixed distance from the shaft to the stack and thereby a substantially constant and fixed drive pressure to the stack.

It will be appreciated that various of the above-disclosed and other features and functions, or alternatives thereof, may be desirably combined into many other different systems or applications. Also that various presently unforeseen or unanticipated alternative, modifications, variations or improvements therein may be subsequently made by those skilled in the art which are also intended to be encompassed by the following claims:

What is claimed is:

1. A finisher compiling structure useful in a marking system which comprises in an operative arrangement:

at least one variable speed drive shaft, at least one frictional drive element mounted to said drive shaft at a distance from receiving sheets in a compiler tray, said compiler tray adapted to house a stack of receiving sheets, at least one drive shaft speed controller, and at least one drive shaft rotational home position sensor, said finisher located in said marking system positioned after said receiving sheet(s) have been marked, a force on said drive element being dependent on at least height of said drive element from said sheets, said controller(s) and sensor(s) sensing said shaft speed and said drive element height monitoring and controlling of the height of said stack from said shaft so that a substantially constant drive force is exerted by said drive element upon said stack of receiving sheets and wherein said speed is sensed to indicate when to index the shaft up away from the stack.

2. The finisher of claim 1 wherein:

said at least one rotational shaft position sensor is located in proximity to said shaft and said compiler tray, said sensor enabled to sense shaft rotation speed and thereby enabling the shaft height indexing system controller to maintain a substantially constant pre-determined height of said drive shaft above said stack of sheets and thereby a substantially constant pre-determined drive force of said drive elements on said receiving sheet(s).

3. A finisher-compiling structure useful in a marking system for post marking finishing operations or steps, said structure comprising in an operative arrangement a compiler tray, at least one drive shaft rotational home position sensor, a drive shaft positioned above said tray, a source of power for said shaft, at least two drive elements or paddle wheels rotably mounted on said drive shaft, each of said paddle wheels having at least one blade, said paddle wheels enabled to drive individual sheets of paper into a stack in said tray and against a registration-compiling wall of said tray, said compiler element drive shaft and wheels adapted to maintain a substantially constant drive force, said tray and paddle wheels adapted to maintain a substantially constant distance between said stack and said paddle wheels, said drive shaft rotational home position sensor having communication with said shaft and paddle wheels height indexing control system to result in a substantially constant and fixed height of the compiler element drive shaft from said stack of sheets to result in a substantially constant and fixed drive pressure to said stack.

4. The finisher of claim 3 located in said marking system at a location after the marking operations and enabled to perform post marking functions on said paper.

5. The finisher of claim 3 wherein said compiling system also includes curl suppressors lightly loaded against said stack and rotably mounted to their own dedicated pivots in said finisher-compiling structure.

6. The finisher of claim 3 whereby speed is sensed to indicate when to index the shaft up away from the stack.

7. The finisher of claim 3 wherein said compiler element drive shaft is enabled to be moved up or down to modify a distance of it from said paper stack.

8. The finisher of claim 3 wherein said tray is enabled to be adjusted vertically to modify its distance from said compiler element drive shaft.

9. The finisher of claim 3 wherein said shaft and height positioning system are enabled to be programmed to provide a constant drive force of said wheels upon said paper stack.

10. The finisher of claim 3 wherein said paddle wheels comprise elastomeric blades enabled to drive individual sheets square against said registration-compiler wall of said tray.

11. The finisher of claim 3 wherein said shaft comprises mounted thereon at least two of said paddle wheels and wherein the curl suppressors have their own dedicated pivots, mounted to the compiler structure frame.

12. A finisher-compiling structure useful in a marking system for post marking finishing operations or steps, said structure comprising in an operative arrangement a compiler tray, at least a compiler element drive shaft rotational home position sensor, a drive shaft positioned above said tray, a source of power for said shaft, at least two drive elements or paddle wheels rotably mounted on said drive shaft, each of said paddle wheels having at least one blade, said paddle wheels enabled to drive individual sheets of paper into a stack in said tray and against a registration-compiling wall of said tray, at least a drive shaft rotational home position sensor, a drive shaft positioned above said tray, a source of power for said shaft, at least two drive elements or paddle wheels mounted on said drive shaft, each of said paddle wheels having at least one blade, said paddle wheels enabled to drive individual sheets of paper into a stack in said tray and against a registration-compiling wall of said tray, said compiler element drive shaft and wheels adapted to maintain a substantially constant drive force, said tray and wheels adapted to maintain a substantially constant distance between said stack and said wheels, said drive shaft rotational home position sensor having communication with said shaft, and wheels height indexing control system to result in a substantially constant and fixed height of the compiler element drive shaft from said stack of sheets to result in a substantially constant and fixed drive pressure to said stack.

13. The finisher of claim 12 located in said marking system at a location after the marking operations and enabled to perform post marking functions on said paper.

14. The finisher of claim 12 wherein said compiling system also includes curl suppressors lightly loaded against said stack and rotably mounted to their own dedicated pivots in said finisher-compiler structure.

15. The finisher of claim 12 wherein said controller is enabled to move said shaft and/or said tray up or down.

* * * * *